US007061171B2

(12) United States Patent
Jung

(10) Patent No.: US 7,061,171 B2
(45) Date of Patent: Jun. 13, 2006

(54) COLOR CATHODE RAY TUBE

(75) Inventor: Ju-Sang Jung, Kyeongsangbuk-Do (KR)

(73) Assignee: LG.Philips Displays Korea Co., Ltd., Kyeongsangbuk-do (KR)

( * ) Notice: Subject to any disclaimer, the term of this patent is extended or adjusted under 35 U.S.C. 154(b) by 191 days.

(21) Appl. No.: 10/748,179

(22) Filed: Dec. 31, 2003

(65) Prior Publication Data

US 2004/0150315 A1 Aug. 5, 2004

(30) Foreign Application Priority Data

Jan. 25, 2003 (KR) ..... 10-2003-0005002

(51) Int. Cl.
*H01J 29/10* (2006.01)

(52) U.S. Cl. ..... 313/470; 313/466

(58) Field of Classification Search ..... 313/461, 313/462, 479, 408, 415, 416, 466, 470
See application file for complete search history.

(56) References Cited

U.S. PATENT DOCUMENTS 4,607,188 A * 8/1986 Brennesholtz ..... 313/461
6,066,914 A 5/2000 Shimizu et al.
6,160,344 A 12/2000 Cho et al.
6,232,712 B1 5/2001 Pyun et al.
6,441,566 B1 * 8/2002 Shimizu et al. ..... 315/368.15
6,465,945 B1 10/2002 Tsuchida et al.
2002/0003396 A1 * 1/2002 Shimizu et al. ..... 313/466

FOREIGN PATENT DOCUMENTS

EP 1061548 A2 * 12/2000
KR 10-1998-0067769 10/1998

* cited by examiner

*Primary Examiner*—Ashok Patel
*Assistant Examiner*—Christopher M. Raabe

(74) *Attorney, Agent, or Firm*—McKenna Long & Aldridge LLP

(57) ABSTRACT

A color cathode ray tube comprising a panel, said panel including an outer surface which is substantially flat and an inner surface on which a screen composed of red, green and blue phosphors is formed, wherein a screen transmittance of the panel increases and then decreases along a line from a center portion to a peripheral portion of the panel, thus to improve brightness uniformity of a center portion, a peripheral portion and a doming portion of the panel.

19 Claims, 7 Drawing Sheets

COLOR CATHODE RAY TUBE

This application claims the benefit of Korean Patent Application No. 2003-5002, filed on Jan. 25, 2003, which is hereby incorporated by reference for all purposes as if fully set forth herein.

BACKGROUND OF THE INVENTION

1. Field of the Invention

The present invention relates to a color cathode ray tube, and more particularly, to a color cathode ray tube capable of preventing degradation of color purity of a panel by optimizing a screen transmittance of the panel and improving brightness uniformity.

2. Discussion of the Related Art

Generally, a cathode ray tube is a device for converting an electric signal into an electric beam and implementing an image by emitting the electron beam onto a phosphor screen. The device produces excellent display quality for a low price, and accordingly it is widely used.

As shown in FIG. 1, the cathode ray tube according to a related art includes a panel 101 which is a front glass, a funnel 102 which is a rear glass for forming a vacuous space when combined with the panel 101, a phosphor screen 113 for functioning as a luminescent material while being coated on an inner surface of the panel 101, an electron gun 106 arranged in a neck of the funnel 102 for emitting an electron beam 105, a deflection yoke 107 for deflecting the electron beam 105 onto the phosphor screen 113 being mounted on an outer circumferential surface of the funnel 102, a shadow mask 108 installed at a predetermined distance from the fluorescent surface 113, a mask frame 109 for fixing/supporting the shadow mask 108, and an inner shield 110 installed inside the funnel 102 for preventing the color purity from being degraded by external magnetic fields.

In operation, the electron beam 105 generated from the electron gun 106 is deflected by the deflection yoke 107, and lands on the phosphor screen 113, which is formed on an inner surface of the panel 101, after passing through a plurality of electron beam passage holes formed in the shadow mask 108. Then, the corresponding green, blue and red phosphors disposed on the phosphor screen 113 are radiated by the electron beam 105, thereby displaying a color image.

Herein, a brightness difference occurs according to a transmittance of the shadow mask 108, a transmittance of the phosphor screen 113 (hereinafter, it is referred to as a 'screen transmittance') and a transmittance of the panel 101 (hereinafter, it is referred to as a 'glass transmittance'). Here, the transmittance of the shadow mask 108 is about 14–19%, the screen transmittance is about 45–60%, and the glass transmittance is about 70–80%. These three kinds of transmittance decrease gradually along from a center portion of the panel 101 to a peripheral portion. Therefore, such differences in transmittance of respective portions of the panel 101 degrade brightness uniformity of the whole surface of the panel 101.

Also, as shown in FIGS. 2A and 2B, as a curved panel having an outer surface with a small radius of curvature is changed to a flat panel having an outer surface with an almost infinite radius of curvature, a wedge ratio, which is a thickness ratio between the center portion of the panel 101 and the peripheral portion of the panel 101, increases. Therefore, as the difference of the glass transmittances between the center portion and the peripheral portion of the panel 101 increases the brightness uniformity of the screen decreases.

In order to improve the brightness uniformity of the cathode ray tube, a glass having a high optical transmittance can be applied to the panel 101 for increasing the glass transmittance of the peripheral portion of the panel 101. However, doing so would deteriorate contrast characteristics including contrast ratio. Therefore, to solve the problem of degraded image contrast, a method of coating colorant or attaching a film containing the colorant on an outer surface of the panel glass may be used. However, it requires an additional coating process, which is generally not necessary for a non-flat type color cathode ray tube. Accordingly, it raises such problems as additional number of parts, additional production cost, difficulties caused by additional production processes and a reduction in yield.

As another method for simultaneously improving the brightness uniformity and contrast characteristics, a tinted glass or a dark-tinted panel glass can be applied on the panel without performing such processes as coating or the like. As shown in Table 1 below, if the tinted glass or the dark-tinted panel glass is applied, the transmittance rapidly decreases along from the center portion to the peripheral portions of the panel. This deteriorates brightness uniformity of the center and peripheral portions. FIG. 3 shows the deterioration of brightness uniformity described above, as the brightness of the center portion of the panel is high and the brightness of the peripheral portion is low, resulting in a 'white ball phenomenon' in that a white spherical shape appears in a center of a screen.

TABLE 1

| | Glass Transmittance (%) | | |
|---|---|---|---|
| Panel Glass | Center portion | Doming portion | Peripheral portion |
| Cleared | 80 | 74 | 70 |
| Tinted | 51 | 35 | 27 |
| Dark tinted | 40 | 24 | 18 |

Table 1 compares glass transmittances at the respective portions of a panel with a tinted glass having a wedge ratio of 200%, a panel with a dark-tinted glass, and a panel with a clear glass without using a tinted or dark-tinted glass. In Table 1, the doming portion is a region positioned between the center portion and the peripheral portion of the panel and affected by a doming effect in which a landing position where the electron beam is landed on the phosphor screen is displaced by heat expansion of the shadow mask caused by impingement of the electron beam.

On the other hand, a method of reducing the wedge ratio is considered. That is, the thickness of the peripheral portion of the panel is reduced to increase the optical transmittance of the peripheral portion of the panel, thereby to improving the brightness uniformity of the whole panel. Herein, by reducing the wedge ratio, the inner surface of the panel becomes flat, which means, a radius of curvature of the inner surface of the panel is increased. Also, a radius curvature of the shadow mask having a dome shape and maintaining a certain distance from the inner surface of the panel must be changed in accordance with the change in the curvature radius of the inner surface of the panel.

However, the radius of curvature of the shadow mask is a main factor determining a howling characteristic according to a structural stiffness, an internal impact resistance, and an external impact resistance of the shadow mask. Thus, if the radius of curvature of the shadow mask increases in accordance with the inner surface of the panel, the mechanical strength of the shadow mask decreases, and the shadow mask is easily deformed during the manufacturing processes.

Therefore, to improve brightness uniformity of the display, there is a limitation to reducing the wedge ratio of the panel, and a more efficient method for improving brightness uniformity is required.

SUMMARY OF THE INVENTION

Accordingly, the present invention is directed to a color cathode ray tube that substantially obviates one or more of the problems due to limitations and disadvantages of the related art.

An object of the present invention is to provide a color cathode ray tube capable of achieving uniform brightness on an entire surface of center, peripheral, and doming portions of a panel by increasing a screen transmittance of the doming portion of the panel, instead of decreasing a screen transmittance of the center portion of the panel, in a panel to which a tinted or dark tinted glass is applied.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the preferred embodiment of the present invention provides a color cathode ray tube comprising a panel, said panel including an outer surface which is substantially flat and an inner surface on which a screen composed of red, green and blue phosphors is formed; wherein a screen transmittance of the panel along a line increases and then decreases along from a center portion to a peripheral portion of the panel.

In another aspect of the present invention, the preferred embodiment of the present invention provides a color cathode ray tube comprising a panel, said panel including an outer surface which is substantially flat and an inner surface on which a screen has red, green and blue phosphors and a black layer, wherein a screen transmittance of the panel satisfies the following conditions; $STM_{HALF} \geqq STM_C$, $STM_{HALF} \geqq STM_H$, wherein $STM_C$ is a screen transmittance at a center portion of the panel, $STM_H$ is a screen transmittance at a short side portion of the panel, and $STM_{HALF}$ is a screen transmittance at a point positioned ½ of the distance between the center portion and the short side portion of the panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 1:
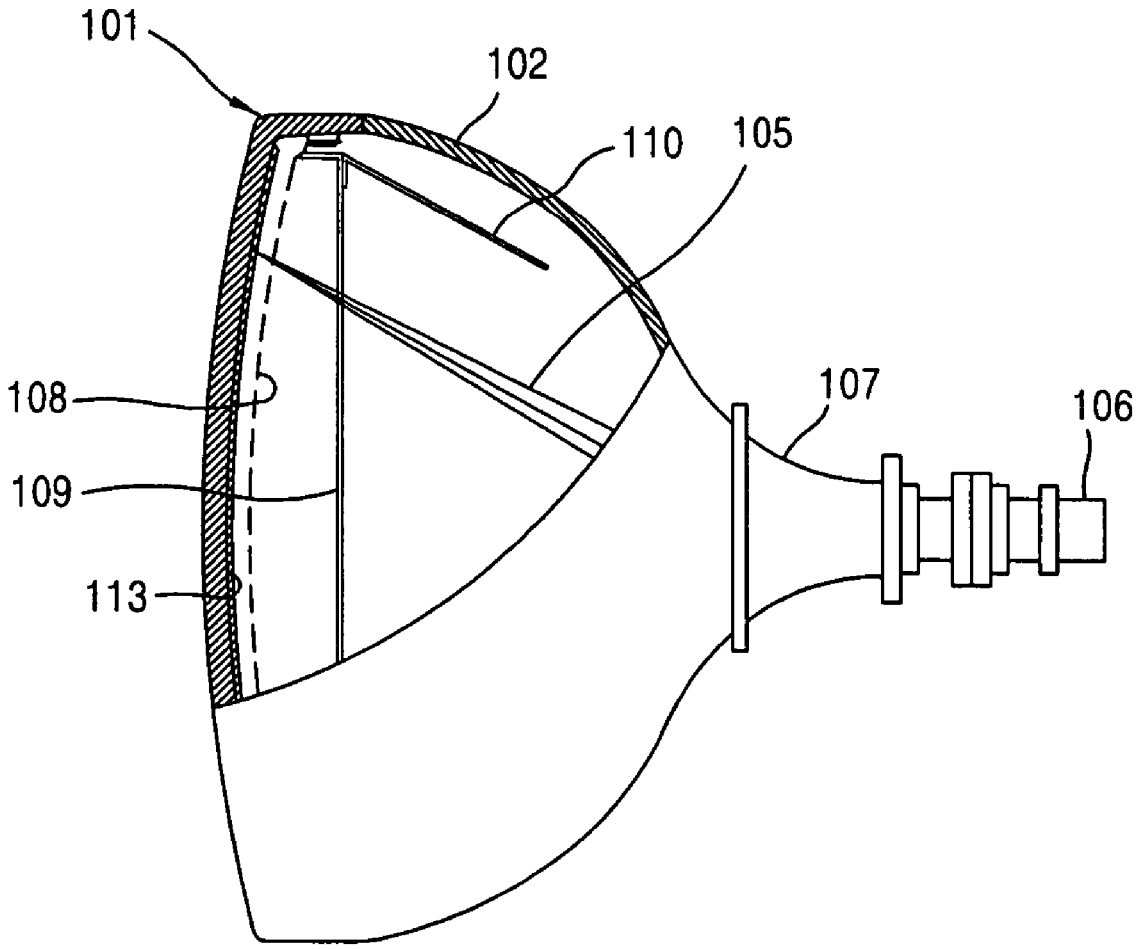
FIG. 1 RELATED ART
FIG. 1 is a schematic view showing a color cathode ray tube according to a related art.
Figure 2A:
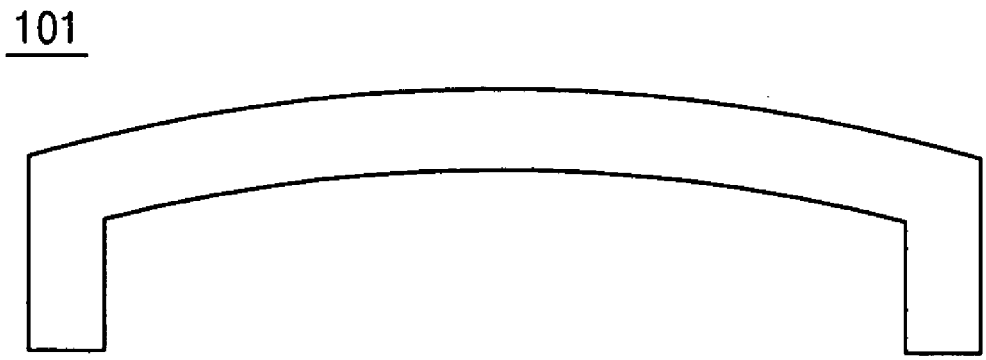
FIG. 2A RELATED ART
FIG. 2A is a schematic view showing a shape of a non-flat type panel of the color cathode ray tube illustrated in FIG. 1 according to the related art.
Figure 2B:
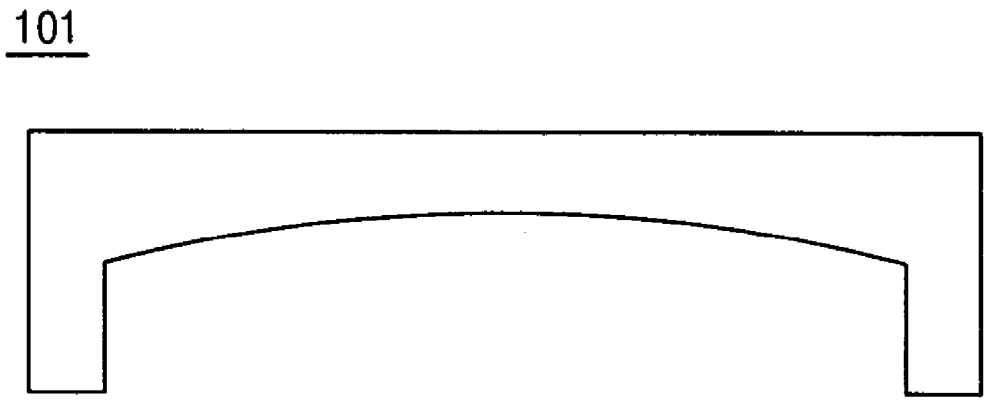
FIG. 2B RELATED ART
FIG. 2B is a schematic view showing a shape of a flat type panel of the color cathode ray tube illustrated in FIG. 1 according to the related art.
Figure 3:
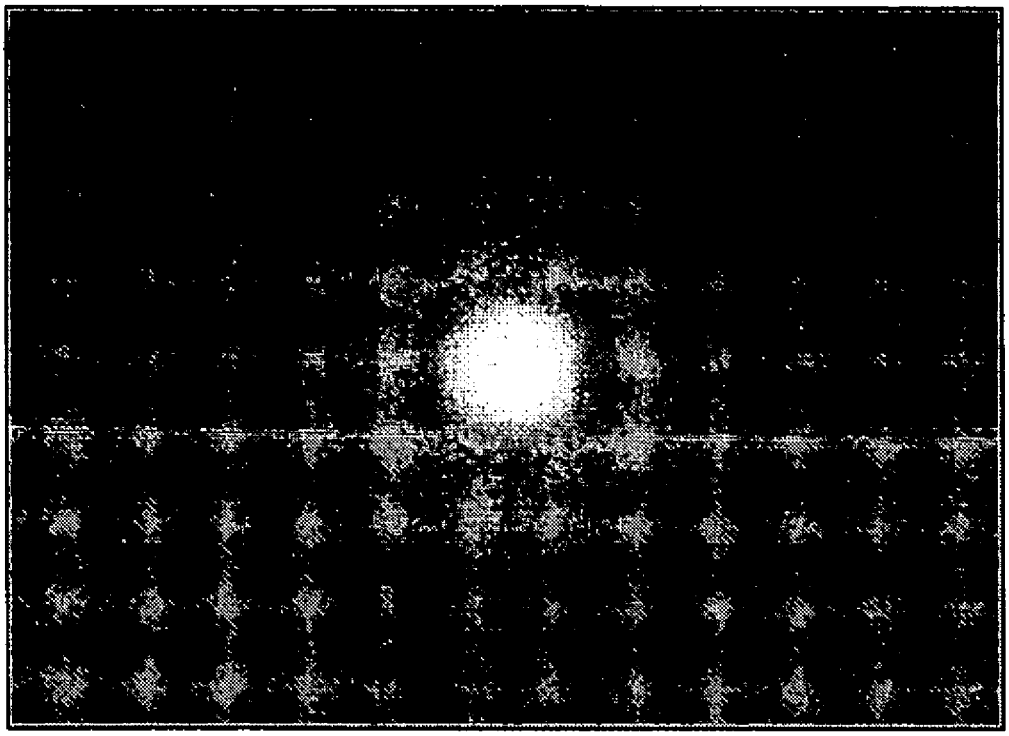
FIG. 3 RELATED ART
FIG. 3 is a view showing lack of uniformity of brightness in the color cathode ray tube illustrated in FIG. 1 according to the related art.
Figure 4:
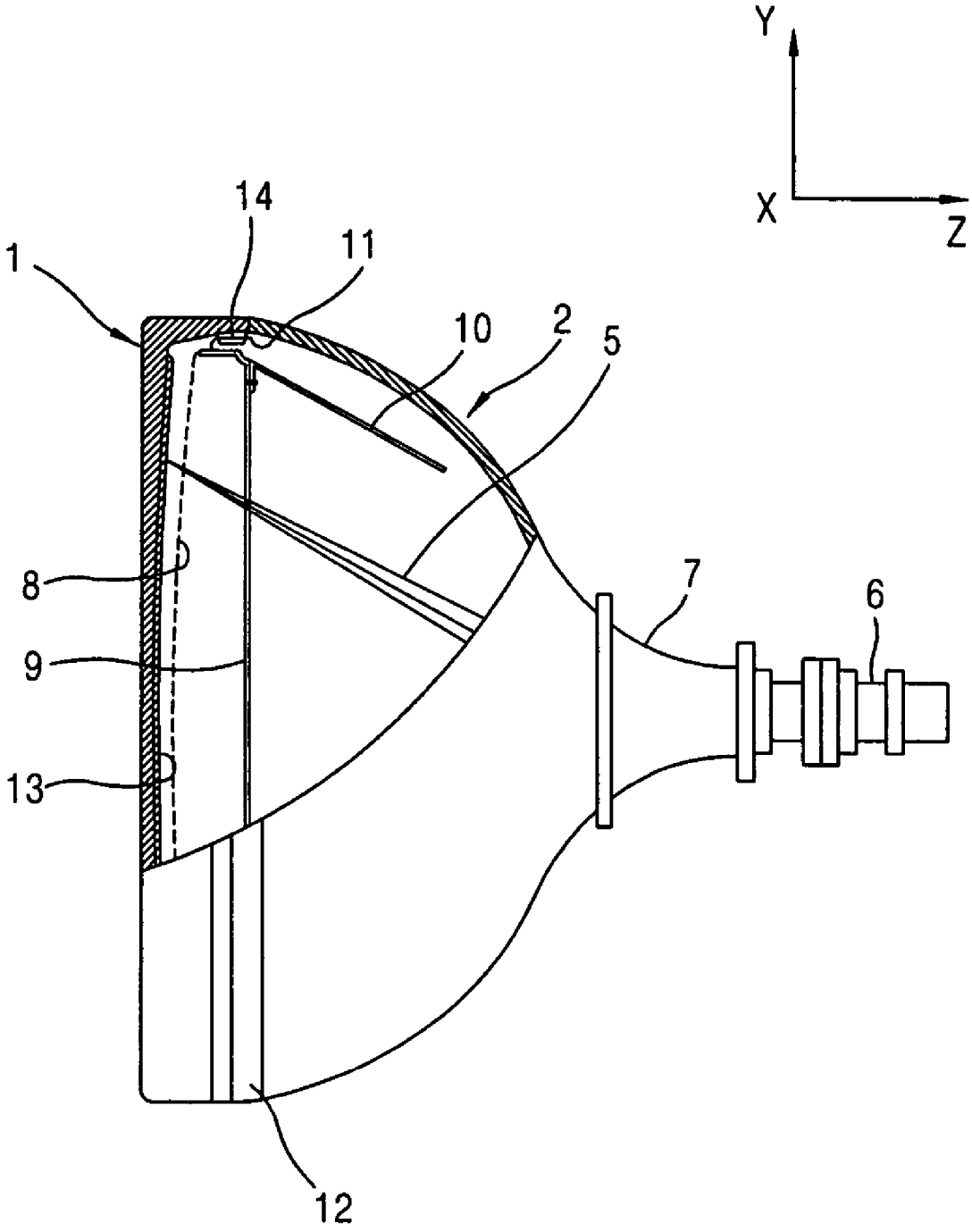
FIG. 4 is a schematic view showing a color cathode ray tube in accordance with the present invention.

As shown in FIG. 4, the color cathode ray tube in accordance with the present invention includes a panel 1 which is a front glass, a funnel 2 which is a rear glass for forming a vacuous space when combined with the panel 1, a phosphor screen 13 for functioning as a luminescent material while being coated on an inner surface of the panel 1, an electron gun 6 positioned at an end of the funnel 2 for emitting the electron beam 5, a deflection yoke 7 for deflecting the electron beam 5 to the phosphor screen 13 being mounted at a separated position on an outer circumferential surface of the funnel 2, a shadow mask 8 installed on a rear side of the panel 1 at a predetermined distance from the fluorescent surface 13, a mask frame 9 for fixing/supporting the shadow mask 8, an inner shield 10 installed in the funnel 2 for preventing the color purity from being degraded by external magnetic fields, a supporting spring 11 mounted at an inner side of the panel 1 for elastically supporting the mask frame 9 on the panel 1, a spring supporter 14 to which the supporting spring is fixed, and a reinforcement band 12 mounted in a circumferential direction of the outer circumferential surface of the panel 1 for reinforcing a combined outer circumferential portion of the panel 1 and the funnel 2.

Figure 5:
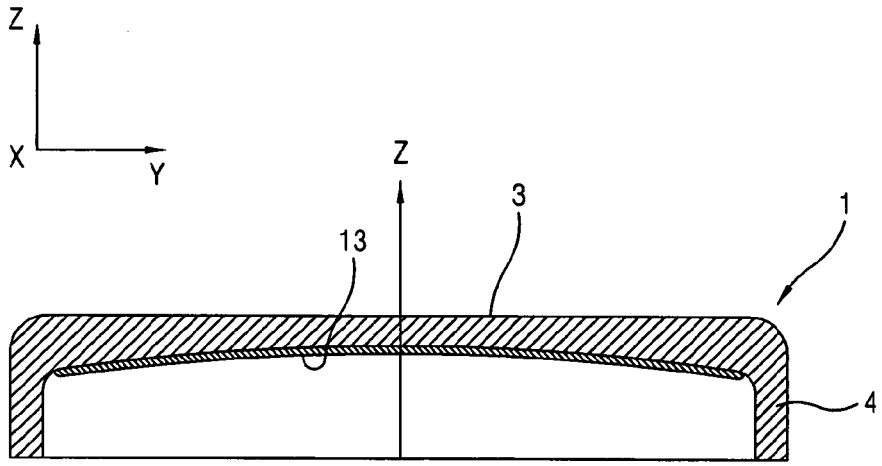
FIG. 5 is a cross-sectional view showing a panel of the color cathode ray tube in accordance with the present invention.

As shown in FIG. 5, the panel 1 includes an effective surface portion 3 in which the phosphor screen 13 is formed on the inner surface thereof, and a skirt portion 4 which is protruded on the circumference of the effective surface portion 3 in the direction of a tube axis (Z-axis) and is combined with the funnel 2.

The shape of the panel 1 is almost a rectangular form, and the outer surface of the panel 1 is substantially flat with a radius of curvature of 30,000 mm or higher. A curvature radius of the inner surface of the panel 1 is formed in a range of 1.2R–8R, where R=(a diagonal size of the effective surface portion 3 of the panel 1)×(1.767).

Figure 6:
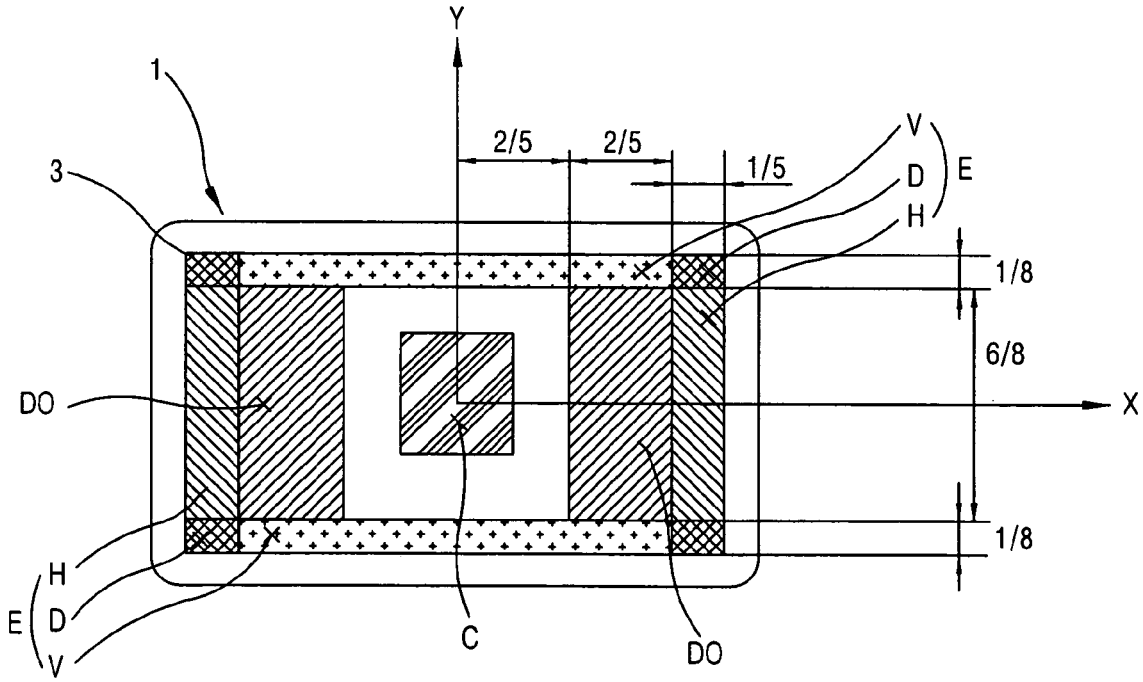
FIG. 6 is a detail view showing an inner surface of the panel of the color cathode ray tube in accordance with the present invention.

Also, as shown in FIG. 6, the effective surface portion 3 of the panel 1 can be divided into a center portion C near the center thereof, a peripheral portion E (which includes a long side portion V which is adjacent to the long side of the panel 1, a short side portion H which is adjacent to the short side of the panel 1 and a corner portion D where the long side and short side of the panel 1 cross each other), and a doming portion DO which is positioned between the long side portion V and the short side portion H.

Here, the doming portion DO is a region where a doming effect occurs in which a landing position where the electron beam 5 lands on the phosphor screen 13 is displaced due to heat expansion of the shadow mask 8 according to the electron beam impinging on the shadow mask. The doming portion DO extends along a major axis (X-axis) from ⅖ to ⅘ and extends along a minor axis (Y-axis) from ⅛ to ⅞ based on ½ of the surface area of the effective surface portion 3 as shown in FIG. 6.

Figure 7:
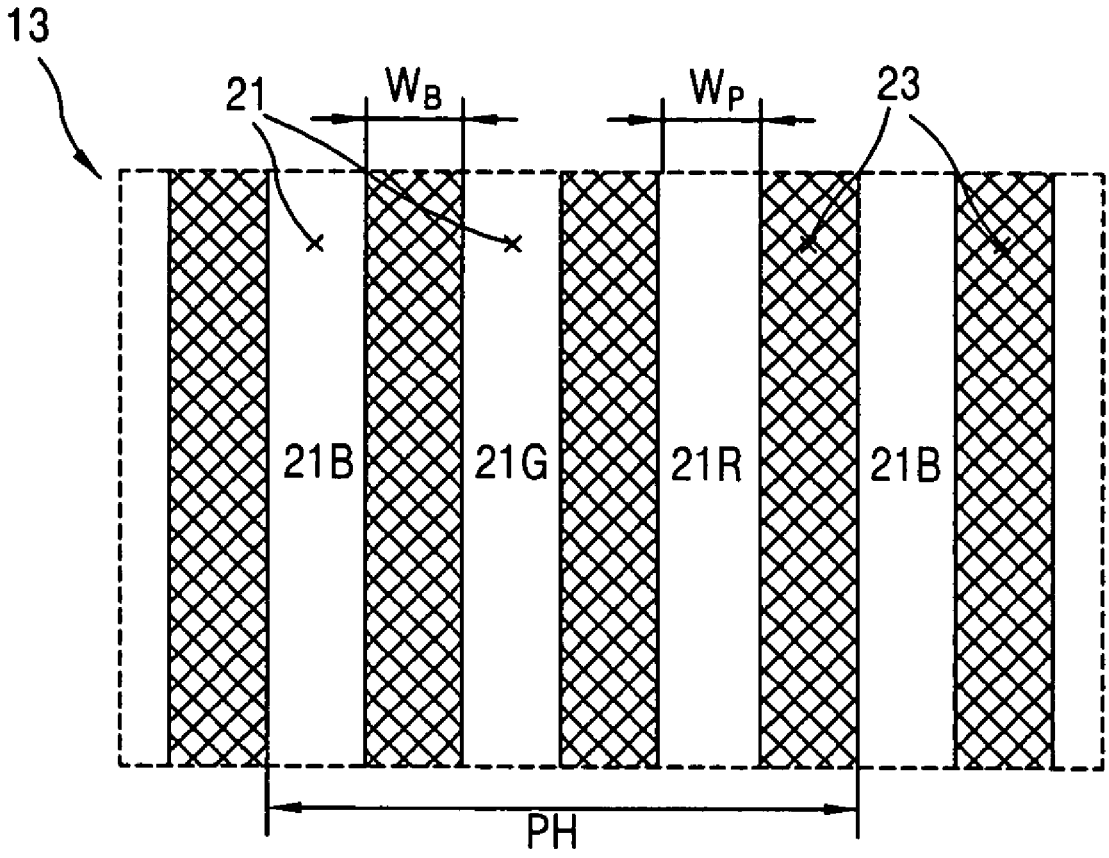
FIG. 7 is a detail view showing a phosphor screen coated on the inner surface of the panel of the color cathode ray tube in accordance with the present invention.

As shown in FIG. 7, the phosphor screen 13 includes a black layer 23 which is coated in parallel to the minor axis (Y-axis) of the panel 1 to have a predetermined interval, and three-color phosphors 21 of blue 21B, green 21G and red 21R which are sequentially coated between the black layers 23.

A width of a set of the phosphors 21B, 21G and 21R and the black layers 23 is the screen pitch PH, and the screen pitch PH is formed to be gradually enlarged along from the center portion C of the effective surface portion 3 of the panel 1 to the peripheral portion E. That is, the widths $W_P$ of the phosphors 21B, 21G and 21R and widths $W_B$ of the respective black layers 21 are gradually increased from the center portion C to the peripheral portion E.

As the glass transmittance of the peripheral portion E of the panel 1 is lower than that of the center portion C of the panel 1, to compensate for the lack of uniformity of the brightness generated by the difference of the glass transmittance, the screen pitch PH of the phosphor screen 13 at the peripheral portion E and the widths $W_P$ of the phosphors 21B, 21G and 21R are formed to be large. Thus, this improves the uniformity of the brightness by increasing the screen transmittance of the peripheral portion E. At this time, the optimum range of the above values is as follows.

As shown in formula 1, the screen pitch PH of the phosphor screen 13 is formed so that a ratio between the screen pitch $PH_C$ at the center portion C of the panel 1 and the screen pitch $PH_E$ at the peripheral portion E of the panel 1 is in a range of 1.4 to 1.7:

$$1.4 \leqq PH_E/PH_C \leqq 1.7 \quad (1)$$

Also, as shown in formulas (2) and (3), a ratio $W_{PC}/W_{PD}$ between a width $W_{PC}$ of the phosphors at the center portion C of the panel 1 and a width $W_{PD}$ of the phosphor at a corner portion D of the panel 1 is in a range of 1.27 to 1.67, and a ratio $W_{PH}/W_{PC}$ between a width $W_{PC}$ of the phosphor at the center portion C of the panel 1 and a width $W_{PH}$ of the phosphor at a short side portion H of the panel 1 is in a range of 1.27 to 1.53:

$$1.27 \leqq W_{PD}/W_{PC} \leqq 1.67 \quad (2)$$

$$1.27 \leqq W_{PH}/W_{PC} \leqq 1.53 \quad (3)$$

On the other hand, the screen transmittance (STM) of the phosphor screen 13 is determined by a ratio between the width $W_P$ of the blue, green and red phosphors 21B, 21G and 21R and the width $W_B$ of the black layer 23. As shown in the following formula (4), such screen transmittance is defined as a percentage of a sum (i.e. screen pitch PH) of the width of a portion where the blue, green and red phosphors 21B, 21G and 21R are coated on the phosphor screen 13 and the width $W_B$ of the black layer 23, that is, a ratio of the screen pitch PH versus the stripe width which is shown as a percentage:

$$STM=(W_{P(BLUE)}+W_{P(GREEN)}+W_{P(RED)})/PH\times 100(\%) \quad (4)$$

Here, the STM is a screen transmittance, $W_{P(BLUE)}$ is a width of the blue phosphor 21B, $W_{P(GREEN)}$ is a width of the green phosphor 21G, $W_{P(RED)}$ is a width of the red phosphor 21R and the PH is a sum of the width of the phosphors and the width of the black layer.

As shown in formula 4, the screen transmittance STM of the panel 1 is related to the width $W_P$ of the phosphors and the width of the black layer 23, and when the width $W_P$ of the phosphors is increased or the width $W_B$ of the black layer 23 is decreased, the screen transmittance is increased. Also, when the width $W_P$ of the phosphors 21 is decreased or the width $W_B$ of the black layer 23 is increased, the screen transmittance is decreased.

On the other hand, as described above, to improve the brightness uniformity and the contrast characteristic of the color cathode ray tube having a panel 1 with a substantially flat outer surface, a tinted or dark-tinted glass may be applied on the panel 1. Here, the panel glass transmittance of the center portion C of the panel 1 is 41–79%.

Also, the wedge ratio of the panel 1 may be decreased to improve the brightness uniformity of the panel 1 to which the tinted or dark-tinted glass is applied. In this case, the wedge ratio may be 140% or higher by considering the impact resistance of the shadow mask.

In addition, to improve the brightness uniformity of the center portion C of the panel 1, the doming portion DO and the peripheral portion E, the screen transmittance $STM_{DO}$ of the doming portion DO of the panel 1 is increased instead of reducing the screen transmittance $STM_C$ of the center portion C of the panel 1.

Accordingly, the screen transmittance of the panel 1 varies from the center portion C to the peripheral portion E. That is, as shown in formula 5 below, the screen transmittance $STM_{HALF}$ of the point ½ of the way between the center portion C and the peripheral portion E of the panel 1 is larger than the screen transmittance $STM_C$ of the center portion C of the panel 1 and the screen transmittance $STM_E$ of the peripheral portion E of the panel 1:

$$STM_{HALF} \geqq STM_C,\ STM_{HALF} \geqq STM_E \quad (5)$$

Also, it is desirable to maximize the screen transmittance of the panel 1 at the doming portion DO and at this time, and it is desirable to have the screen transmittance $STM_C$ of the center portion C of the panel 1 at 60% or lower:

$$STM_C \leqq 60\% \quad (6)$$

The brightness uniformity is degraded by the white ball phenomenon as the width $W_{PC}$ of the phosphor at the center portion C is increased in an effort to increase the brightness because the screen transmittance $STM_C$ of the center portion C is higher than 60%.

Also, as the screen transmittance at the peripheral portion E and the doming portion DO of the panel 1 is increased, the brightness is better. However, the stripe width $W_P$ of the phosphors becomes too large. Therefore, the width $W_B$ of the black layer 23 is relatively reduced, and accordingly, the electron beam that would be blocked by the black layer 23 affects another phosphor. Therefore, as degradation of color purity occurs, it is preferable that the screen transmittances $STM_E$ and $STM_{DO}$ of the peripheral portion E and the doming portion DO are formed as 65% or lower as shown in formula (7) below.

$$STM_E \leqq 65\%,\ STM_H \leqq 65\% \quad (7)$$

Also, it is desirable to make the screen transmittance of the panel 1 increase from the center portion C to the long side portion V. To increase the screen transmittance from the center portion C to the long side portion V, as shown in formula (8) below, a ratio between the width $W_{PC}$ (of R, G, B) of the phosphor at the center portion C of the panel 1 and a width $W_{PV}$ of the phosphor at the long side portion V of the panel 1 is made to be in a range of 0.9 to 1.10:

$$0.9 \leqq W_{PV}/W_{PC} \leqq 1.10 \quad (8)$$

Also, it is desirable that the ratio $STM_V/STM_C$ between the screen transmittance $STM_C$ of the center portion C and the screen transmittance $STM_V$ of the long side portion V (formula 9), and the ratio $STM_H/STM_C$ between the screen transmittance $STM_C$ of the center portion C and the screen transmittance $STM_H$ of the short side portion H (formula 10) are in the range of 0.94 to 1.16:

$$0.94 \leqq STM_V/STM_C \leqq 1.16 \quad (9)$$

$$0.94 \leqq STM_H/STM_C \leqq 1.16 \quad (10)$$

In the case when the ratio $STM_V/STM_C$ and the ratio $STM_H/STM_C$ are higher than 1.16, the width of the phosphor of the long side portion V and the short side portion H are increased. Accordingly, the electron beam cannot hit a proper phosphor and consequently affects other phosphors. Therefore, the color purity of the long side portion V and the short side portion H is degraded. Also, in the case when the ratio $STM_V/STM_C$, and the ratio $STM_H/STM_C$ are lower than 0.94, the width of the phosphor of the long side portion V and the short side portion H are decreased. Because the brightness of the long side portion V and the short side portion H are decreased, the difference in the brightness becomes larger than in the center portion C of the panel 1, which degrades the brightness uniformity of the panel 1.

Also, it is desirable that a ratio $STM_{DO}/STM_C$ between the screen transmittance $STM_C$ of the center portion C of the panel and a screen transmittance $STM_{DO}$ of the doming portion DO is in a range of 1.00 to 1.13 as follows:

$$1.00 \leqq STM_{DO}/STM_C \leqq 1.13 \quad (11)$$

In the case when the ratio $STM_{DO}/STM_C$ is higher than 1.13, the width $W_P$ of the phosphor at the doming portion DO is increased and the width $W_B$ at the black layer 23 is decreased and the electron beam affects other phosphors, which degrades the color purity. In the case when the ratio $STM_{DO}/STM_C$ is lower than 1.00, the screen transmittance is decreased and accordingly, a phenomenon occurs in which the doming portion DO is shown to be dark. Therefore, the white ball phenomenon occurs to degrade brightness uniformity.

Here, in order to have the ratio $STM_{DO}/STM_C$ in the range of 1.00 to 1.13, the ratio between the width $W_{PC}$ of the phosphor at the center portion C and the width $W_{PDO}$ of the phosphor at the doming portion DO should be in a range of 1.05 to 1.25:

$$1.05 \leqq W_{PDO}/W_{PC} \leqq 1.25 \quad (12)$$

Figure 8:
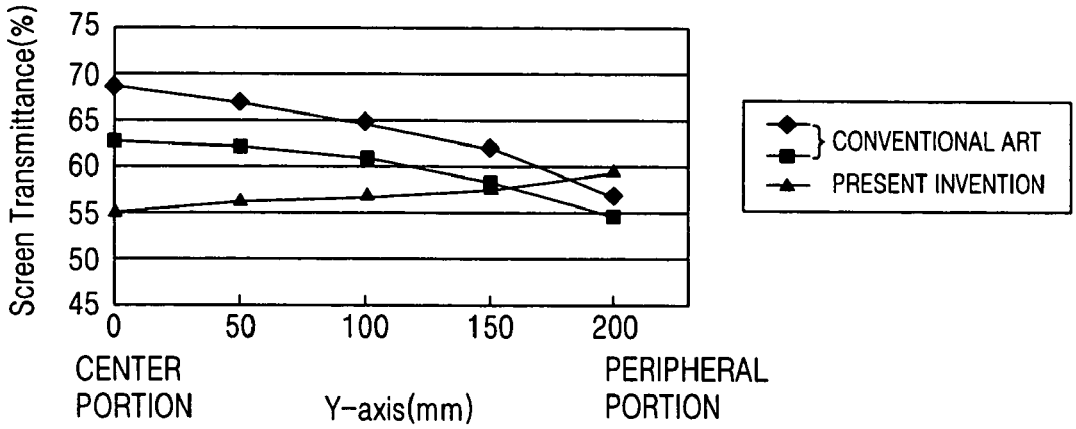
FIG. 8 is a graph comparing a screen transmittance of each portion measured along a line from a center of the panel to a peripheral portion on a minor axis (Y-axis) in accordance with the present invention and the conventional art.
Figure 9:
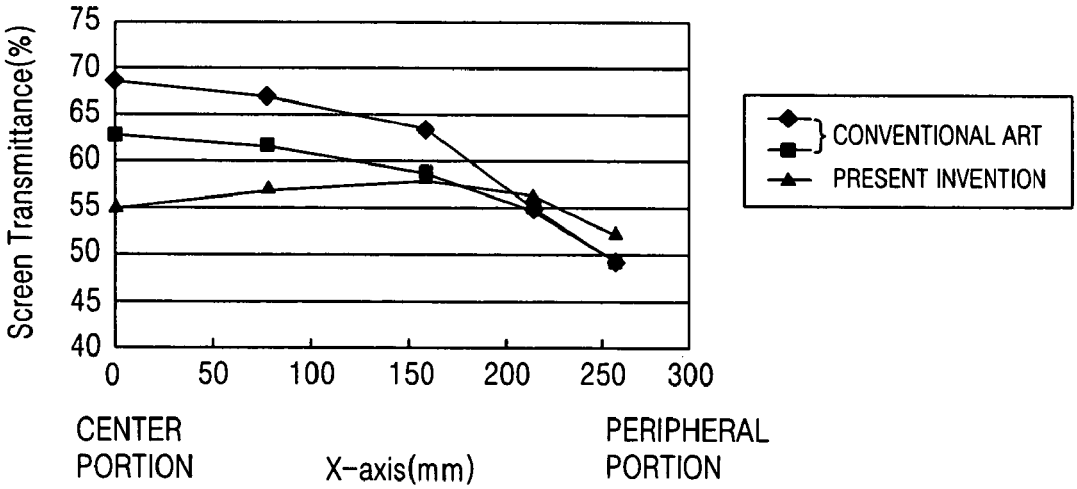
FIG. 9 is a graph comparing a screen transmittance of each portion measured along a line from a center of the panel to a peripheral portion on a major axis (X-axis) in accordance with the present invention and the conventional art.

The effect of the color cathode ray tube in accordance with the present invention will be described with reference to FIGS. 8 and 9. FIG. 8 is a graph comparing the screen transmittance of each portion measured from the center portion of the panel to the peripheral portion along a minor axis (Y-axis) in accordance with the present invention and the conventional art. FIG. 9 is a graph comparing the screen transmittance of each portion measured from the center portion of the panel to the peripheral portion along a major axis (X-axis) in accordance with the present invention and the conventional art.

As shown in FIG. 8, when comparing the screen transmittance of each portion along the minor axis (Y-axis), in the conventional color cathode ray tube, the screen transmittance at the center portion of the panel is high and the screen transmittance gradually decreases toward the peripheral portion. Accordingly, there is a large difference between the screen transmittance of the center portion and the peripheral portion. However, for the color cathode ray tube of the present invention, the screen transmittance gradually increases in a more gentle slope from the center portion of the panel to the peripheral portion, and the difference in the screen transmittance of the center portion and the peripheral portion is minimized.

Also, as shown in FIG. 9, when comparing the screen transmittance of each portion along the major axis (X-axis), in the conventional color cathode ray tube, the screen transmittance at the center portion of the panel is high and the screen transmittance gradually decreases toward the peripheral portion of the panel. Accordingly, there is a large difference in the screen transmittance of the center and peripheral portions. However, for the color cathode ray tube of the present invention, the screen transmittance gradually increases in a more gentle slope from the center portion of the panel toward the peripheral portion and then decreases further toward the peripheral portion. Again, the difference of the screen transmittance of the center portion and the peripheral portion is minimized. At this time, the screen transmittance in the doming portion is maximized.

Thus, in the color cathode ray tube of the present invention, the brightness of the center portion of the panel is lower than that of the conventional color cathode ray tube and the brightness of the peripheral portion of the panel is higher than that of the conventional color cathode ray tube to achieve a uniform brightness over the entire surface of the center portion, the doming portion and the peripheral portion of the panel.

As described above, in the color cathode ray tube in accordance with the present invention, the brightness uniformity on an entire surface of the center portion, the peripheral portion and the doming portion of the panel may be achieved by applying tinted or dark-tinted glass and increasing the screen transmittance of the doming portion of the panel instead of lowering the screen transmittance of the center portion of the panel to improve the brightness and contrast of the screen.

It will be apparent to those skilled in the art that various modifications and variation may be made in the present invention without departing from the spirit or scope of the invention. Thus, it is intended that the present invention cover the modifications and variations of this invention provided they come within the scope of the appended claims and their equivalents.

What is claimed is:

1. A color cathode ray tube comprising:

a panel, said panel including an outer surface which is substantially flat and an inner surface on which a screen composed of a black layer and red, green and blue phosphors is formed;

wherein a screen transmittance of the panel equals to (a width of the red phosphor+a width of the green phosphor+a width of the blue phosphor)/(the widths of the red, green and blue phosphors+widths of the black layers between the red, green and blue phosphors)×100, and wherein said screen transmittance of the panel increases and then decreases along a line from a center portion to a peripheral portion of the panel.

2. The cathode ray tube of claim 1, wherein the screen transmittance of the panel satisfies the following condition;

$$STM_{HALF} \geqq STM_C STM_{HALF} \geqq STM_E$$

wherein $STM_C$ is a screen transmittance at the center portion of the panel, $STM_E$ is a screen transmittance at the peripheral portion, and $STM_{HALF}$ is a screen transmittance at a point positioned about ½ the distance between the center portion and the peripheral portion.

3. The cathode ray tube of claim 1, wherein the screen transmittance of the panel is maximized at a doming portion, and wherein the doming portion is a region extending along a major axis from ⅖ to ⅘ and extending along a minor axis from ⅛ to ⅞ on a basis of ½ of the surface of an effective surface portion of the panel in which the screen is formed.

4. The cathode ray tube of claim 1, wherein the screen transmittance in the center portion of the panel is 60% or lower.

5. The cathode ray tube of claim 1, wherein the screen transmittance of the panel is increases from the center portion of the panel to a long side portion of the panel along a major axis of the panel.

6. The cathode ray tube of claim 1, wherein, $$0.94 < STMv/STMc \leqq 1.16, \text{ and}$$

$$0.94 \leqq STM_V/STM_C \leqq 1.16, \text{ and}$$

$$0.94 \geqq STM_H/STM_C \leqq 1.16,$$

wherein $STM_C$ is a screen transmittance of the center of the panel, $STM_V$ is a screen transmittance of a long side portion, and $STM_H$ is a screen transmittance of a short side portion.

7. The cathode ray tube of claim 1, wherein:

$$1.00 \leqq STM_{DO}/STM_C \leqq 1.13,$$

wherein a doming portion is a region extending along a major axis from ⅖ to ⅘ and extending along a minor axis from ⅛ to ⅞ On a basis of ½ of the surface of an effective surface portion of the panel in which the screen is formed, $STM_C$ is a screen transmittance of the center of the panel, and $STM_{DO}$ is a screen transmittance of the doming portion.

8. The cathode ray tube of claim 1, wherein, $$1.05 W_{PDO}/W_{PC} \leqq 1.25,$$

wherein the doming portion is a region extending along a major axis from ⅖ to ⅘ and extending along a minor axis from ⅛ to ⅞ On a basis of ½ of the surface of an effective surface portion of the panel in which the screen is formed, $W_{PC}$ is a width of the phosphor at the center portion of the panel, and $W_{PD}$ is a width of the phosphor at the doming portion of the panel.

9. The cathode ray tube of claim 1, wherein, $$0.90 \leqq W_{PV}/W_{PC} \leqq 1.1.0,$$

wherein $W_{PC}$ is a width of the phosphor at the center portion of the panel, and $W_{PV}$ is a width of the phosphor at a long side portion of the panel.

10. A color cathode ray tube comprising:

a panel, said panel including an outer surface which is substantially flat and an inner surface on which a screen composed of red, green and blue phosphors and black layer;

wherein a screen transmittance of the panel satisfies the following conditions:

$$STM_{HALF} \geqq STM_C, \text{ and}$$

$$STM_{HALF} \geqq STM_H;$$

wherein said screen transmittance of the panel equals to (a width of the red phosphor+a width of the green phosphor+a width of the blue phosphor)/(the widths of the red, green and blue phosphors+widths of the black layers between the red, green and blue phosphors)×100, wherein $STM_C$ is a screen transmittance at a center portion of the panel, $STM_H$ is a screen transmittance at a short side portion of the panel, and $STM_{HALF}$ is a screen transmittance at a point positioned about ½ of the distance between the center portion and the short side portion of the panel.

11. The cathode ray tube of claim 10, wherein a glass transmittance of the panel is 41–79%.

12. The cathode ray tube of claim 10, wherein a screen pitch of the screen is increased from the center portion of the panel to a peripheral portion of the panel.

13. The cathode ray tube of claim 10, wherein a width of the phosphor of the screen increases from the center portion of the panel to a peripheral portion of the panel along a major axis of the panel.

14. The cathode ray tube of claim 10, wherein:

$$1.4 \leqq PH_E/PH_C \leqq 1.7,$$

wherein $PH_C$ is a screen pitch of the phosphor at the center portion of the panel and $PH_E$ is a screen pitch of the phosphor at a peripheral portion of the panel.

15. The cathode ray tube of claim 10, wherein:

$$1.27 \leqq W_{PD}/W_{PC} 1.67,$$

wherein $W_{PC}$ is a width of the phosphor at the center portion of the panel, and $W_{PD}$ is a width of the phosphor at a corner portion of the panel.

16. The cathode ray tube of claim 10, wherein:

$$1.27 \leqq W_{PH}/W_{PC} 1.53,$$

wherein $W_{PC}$ is a width of the phosphor at the center portion of the panel, and $W_{PH}$ is a width of the phosphor at the short side portion of the panel.

17. The cathode ray tube of claim 10, wherein a radius of curvature of the outer surface of the panel is 30,000 mm or longer.

18. The cathode ray tube of claim 10, wherein the inner surface of the panel has a radius of curvature in a range of about 1.2R to 8R where R is obtained by multiplying a diagonal length of an effective surface of the panel in which the phosphor screen is formed by 1.767.

19. The cathode ray tube of claim 10, wherein a wedge ratio which is a ratio between a thickness of glass at the center of the panel and a thickness of glass at a peripheral portion of the panel is about 140% or higher.

* * * * *